US010677456B2

(12) United States Patent
Luo et al.

(10) Patent No.: US 10,677,456 B2
(45) Date of Patent: Jun. 9, 2020

(54) WAVEGUIDE ANTENNA FOR MICROWAVE ENHANCED COMBUSTION

(71) Applicant: Southwest Research Institute, San Antonio, TX (US)

(72) Inventors: Yilun Luo, Ann Arbor, MI (US); Ronnie E. Randolph, San Antonio, TX (US); Douglas A. McKee, Helotes, TX (US); Graham T. Conway, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 157 days.

(21) Appl. No.: 15/858,977

(22) Filed: Dec. 29, 2017

(65) Prior Publication Data

US 2019/0203931 A1 Jul. 4, 2019

(51) Int. Cl.

| | |
|---|---|
| ***F23C 99/00*** | (2006.01) |
| ***H01Q 1/36*** | (2006.01) |
| ***H01Q 13/00*** | (2006.01) |
| ***H01Q 1/32*** | (2006.01) |

(52) U.S. Cl.

CPC ..... *F23C 99/001* (2013.01); *H01Q 1/3208* (2013.01); *H01Q 1/36* (2013.01); *H01Q 1/366* (2013.01); *H01Q 13/00* (2013.01)

(58) Field of Classification Search

CPC ..... F23C 99/001
USPC ..... 431/254, 6, 10, 11
See application file for complete search history.

(56) References Cited

U.S. PATENT DOCUMENTS

| | | | | |
|---|---|---|---|---|
| 5,342,586 | A * | 8/1994 | Park | F02M 27/02 123/538 |
| 5,370,525 | A * | 12/1994 | Gordon | F23C 7/004 431/11 |
| 5,845,480 | A | 12/1998 | DeFreitas et al. | |
| 6,782,875 | B2 | 8/2004 | Yoshimoto | |
| 7,671,309 | B2 | 3/2010 | Kumar et al. | |
| 2008/0176058 | A1* | 7/2008 | Maschmann | B82Y 30/00 428/315.5 |
| 2017/0328337 | A1* | 11/2017 | Ikeda | F02P 3/01 |

FOREIGN PATENT DOCUMENTS

WO 2014205528 A1 12/2014

OTHER PUBLICATIONS

Li, Y. et al: "EM Field Enabled Timing Control of HCCI Engines"; Proc. 7th Asia-Pacific Conf on Control and Measurement, pp. 39-44, Nyingchi, Tibet, China, Aug. 2006.

* cited by examiner

*Primary Examiner* — Avinash A Savani
(74) *Attorney, Agent, or Firm* — Grossman, Tucker, Perreault & Pfleger, PLLC

(57) ABSTRACT

The present invention is directed at a waveguide antenna for microwave enhanced combustion of a previously ignited fuel-air mixture. The waveguide antenna has a thermal conductivity of at least 150 W/m–k and can be formed from a metallic shell with a ceramic core.

17 Claims, 2 Drawing Sheets

WAVEGUIDE ANTENNA FOR MICROWAVE ENHANCED COMBUSTION

FIELD

The present invention is directed at a waveguide antenna for microwave enhanced combustion of a previously ignited fuel-air mixture. The waveguide antenna has a thermal conductivity of at least 150 W/m–k.

BACKGROUND

U.S. Pat. No. 5,845,480 reports on an ignition apparatus for a combustor that includes a microwave energy source that emits microwave energy into the combustor, and a laser energy source that emits laser energy into the combustor so that plasma is produced that ignites a combustible mixture therein.

U.S. Pat. No. 6,782,875 reports on a system and method for conditioning or vaporizing fuel within an internal combustion engine in order to effectuate more complete combustion. Reference is made to the use of an electromagnetic wave source configured for introducing electromagnetic waves into the fuel conditioning cavity and into the fuel spray to effectuate volumetric heating of a droplet of fuel spray once ejected from the fuel injector.

WO201405528 reports on a microwave ignition system that is organized as three sections, namely an ignition module, a magnetron and a waveguide and also using an electromagnetic wave within a spectrum of form 1000 MHz to 2450 MHz, promoting molecular agitation of the fossil fuel and causing the development of a short-circuit current within the combustion chamber of the engine, wherein the energy provided by the microwave deflagrates the combustion of fuel, irrespective of whether the latter is diesel, gasoline or alcohol, i.e. it ruptures the molecules involved in the combustion process.

Reference is also made to the paper "*EM Field Enabled Timing Control of HCCI Engines*", Proced. 7$^{th}$ Asia-Pacific Conference On Control and Measurement, 2006, which identifies that a cylinder cavity can be excited by a waveguide through small openings on the walls or by a small coaxial-line probe or loop as the ignitor for Homogeneous Charge Compression Ignition (HCCI).

SUMMARY

A combustion method comprising a combustor having a combustion region for introducing a combustible mixture, including an elongated waveguide antenna positioned in the combustor wherein the antenna is connected to a microwave power source and wherein the waveguide antenna indicates a thermal conductivity of at least 150 W/m–K. One then introduces a combustible mixture into the combustor and ignites the combustible mixture and utilizes microwave energy from the waveguide antenna to enhance combustion of the previously ignited mixture.

In product form, the present invention is directed at a combustion system for microwave enhanced combustion comprising a combustor having a combustion region for introducing a combustible mixture. An elongated waveguide antenna is positioned in the combustor wherein the antenna is connected to a microwave power source and wherein the waveguide antenna indicates a thermal conductivity of at least 150 W/m–K to 300 W/m–k. The antenna emits microwave energy that does not ignite the combustible mixture but is sufficient to enhance combustion once ignition is achieved.

DESCRIPTION OF THE DRAWINGS

The invention will be more fully understood from the following detailed description taken in conjunction with the accompany drawings in which.

DETAILED DESCRIPTION OF THE INVENTION

Figure 1:
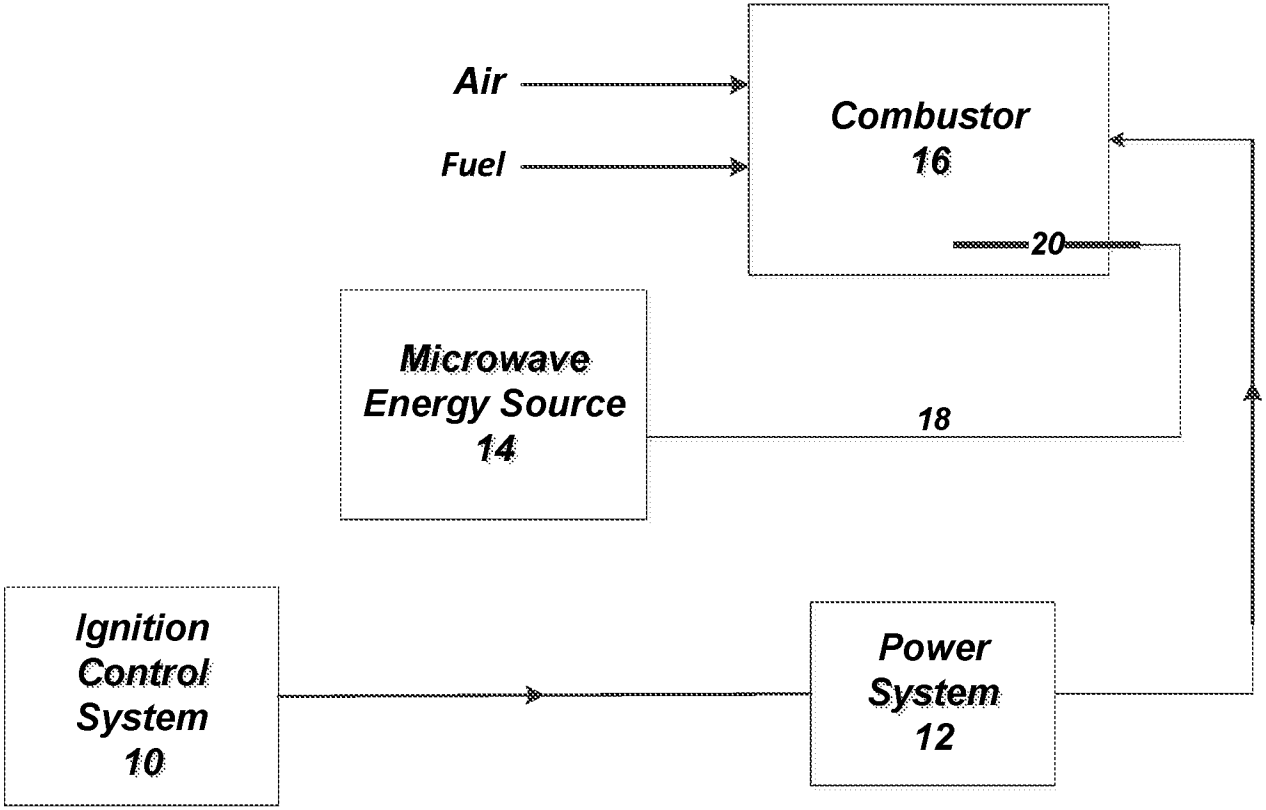
FIG. 1 is a simplified block diagram of a combustion engine making use of the waveguide antenna herein for microwave enhanced combustion.

The present invention is directed at the use of an elongated waveguide antenna for microwave enhanced combustion (MEC). Reference to MEC is understood herein to include the use of microwaves (MW) to enhance the plasma or flame development in the combustion environment. Such is therefore contemplated to include, but not be limited to, an increase in the ignited flame speed within a combustor (cylinder), improvement in combustion stability, thermal efficiency (e.g. heat loss), dilution tolerance (e.g. ability to run at relatively leaner mixtures, and tolerate increased amount of exhaust gas recirculation (EGR)) and/or reduction in selected emissions. Accordingly, it should be understood that the microwave energy introduced to the waveguide antenna herein is not introduced to provide for ignition of a given combustible mixture of air and fuel in the combustor, but to enhance combustion, as noted, once ignition has been otherwise achieved. Furthermore, the microwaves utilized herein for MEC in the disclosed waveguide antenna are preferably those having a frequency of 7.0 GHz to 9.0 GHz. The operation frequency can be increased by decreasing the diameter of the circular waveguide antenna, or width and height of the rectangular waveguide antenna, and vice versa Reference to an elongated waveguide antenna herein is reference to a structure that has a length and conveys the microwave electromagnetic radiation into the combustor for MEC. Preferably, the elongated waveguide antenna utilized herein has a ceramic core with a diameter of 8.0 mm to 12.0 mm and a metallic shell (e.g. stainless steel with/without coating) having a thickness of 1.0 mm to 2.0 mm. The coating may be selected from Cu, Ag or Au and may be present at a thickness of 5.0 to 50 microns. More preferably, the ceramic core has a diameter of 9.0 mm to 11.0 mm, and in a highly preferred embodiment, the ceramic core has a diameter of 9.8 mm to 10.2 mm. Such elongated waveguide antenna preferably has a length to reach out of the cylinder, e.g. 50 mm to 250 mm, more preferably in the range of 100 mm to 200 mm.

Reference to ceramic herein is reference to the use of inorganic non-metallic material, which is preferably sourced from oxide or nitride material that indicates a thermal conductivity of at least 150 W/m–k, more preferably in the range of 150 W/m–K to 300 W/m–K. Even more preferably the thermal conductivity of the ceramic in the rod is in the range of 175 W/m–K to 250 W/m–K, and in a particular preferred configuration, the ceramic has a thermal conductivity in the range of 200 W/m–k to 250 W/m–k. It is contemplated that such relatively high levels of thermal conductivity will prevent the antenna from otherwise storing combustion heat which may then cause uncontrolled ignition and engine damaging knock.

The ceramic rod of the waveguide antenna herein preferably comprises, consists essentially of, or consists of aluminum nitride (AlN) or beryllium oxide (BeO). The waveguide antenna herein is preferably formed by selecting the metallic shell of preferred diameter, heating to expand the shell and inserting a ceramic rod and allowing the metallic shell to cool and engage (via a shrink-fit) to the ceramic rod inserted therein. However, it can be appreciated that other methods may be employed to provide the microwave waveguide antenna herein having a ceramic core within a metallic shell, such as filling the metallic shell with the ceramic material and heating to fuse and immobilize the ceramic material within the selected metallic shell structure, or surface metalize the ceramic core by coating, sputtering, or plating.

It is worth noting that the use of a ceramic core waveguide antenna for MEC offers various other advantages. For example, the use of a ceramic core waveguide antenna is such that it now has the strength to support and maintain performance upon exposure to the relatively high cylinder pressures that may be experienced, such as cylinder pressures up to 250 bar. In addition, the ceramic core waveguide antenna is also contemplated to be capable of withstanding the relatively high temperatures of combustion, which can include temperatures of up to 2000° C. In addition, the ceramic core waveguide antenna herein is such that the ceramic core is contemplated to have improved electrical insulating characteristics than a hollow waveguide which relies upon air.

The waveguide antenna is coupled to a microwave power source. The microwave power source herein is such that the power utilized for MEC is in the relatively low range of 75.0 watts (W) to 500.0 watts (W). More preferably, the power for the waveguide microwave antenna herein is in the range of 90.0 W to 150.0 W, and in a particular preferred configuration, the microwave antenna herein is one that has a power of 100.0 W (+/−10.0 W). The waveguide antenna herein is also one that can undergo a pulsed power cycle, such that the antenna provides its power for desired length of time (e.g., in the range of 1.0 to 10.0 microseconds) and then remains dormant until again required in a given engine duty cycle. It should therefore be noted that the microwave waveguide antenna herein can handle power up to 3 kW if necessary for a given engine configuration.

FIG. 1 is a simplified block diagram of a combustion engine that relies upon a separate ignition control system 10 that includes various electronic circuits and a power system 12 for controlling when ignition is to start or restart. In a conventional spark-plug system, the ignition control system and power system creates the spark that is necessary for ignition. A microwave energy source is shown at 14 which then can feed an open or hollow waveguide 18 that couples with the ceramic core waveguide antenna 20 described herein that is positioned in the combustor 16. In such regard, it should be noted that the hollow waveguide 18 may be coupled to the waveguide antenna 20 without the need for any adaptor, which therefore avoids adaptor loss and reflection problems and bandwidth limitations.

The combustor is reference to any structure having a combustion region or chamber within which a combustible mixture, such as air and fuel, is ignited by a separate ignition source to form a plasma or flame, which combustion is then enhanced by microwave energy provided by the waveguide antenna 20. Accordingly, the combustor 16 includes a cylinder of a reciprocating engine which provides combustion and includes the space for piston travel. As noted above, the waveguide antenna is one that preferably has a thermal conductivity in the range of 150 W/m−K to 300 W/m−K, and is preferably a metallic shell over a ceramic core. Accordingly, in the context of the present invention, the waveguide antenna for microwave enhanced combustion is contemplated for use in an internal combustion engine where ignition is separately provided. Ignition may therefore include the use of an ignition control system 10 and power system 12 as shown in FIG. 1. In addition, ignition may be configured herein to include a diesel internal combustion engine where ignition occurs as a consequence of highly compressed hot air that ignites the fuel. Moreover, the waveguide antenna herein may be utilized in other engine platforms, such as a turbine engine used in jets, a natural gas turbine engine or reciprocating engine configuration as well as dual fuel type engine configurations, which can for example rely upon gasoline or diesel in combination with natural gas, liquefied petroleum gas (LPG) or hydrogen.

Figure 2:
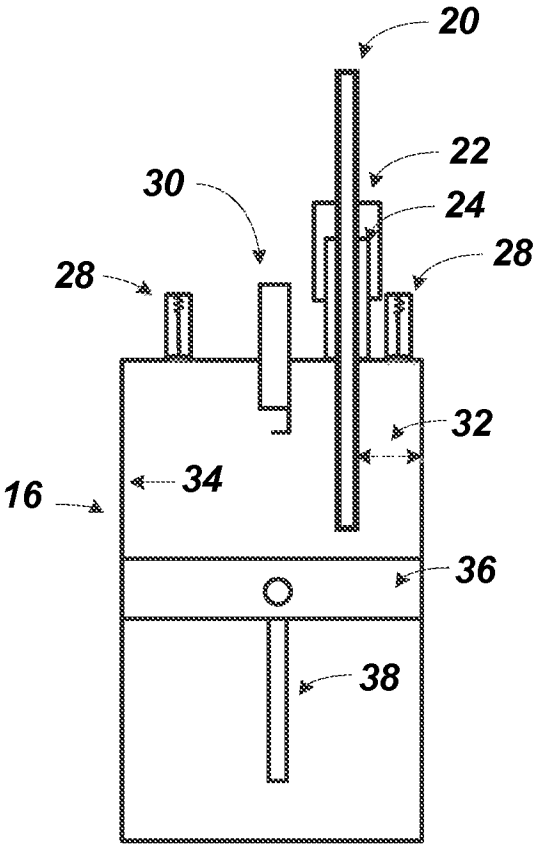
FIG. 2 is a simplified diagram of a combustor (cylinder) utilizing the waveguide antenna herein for microwave enhanced combustion.

As illustrated in FIG. 2, the elongated waveguide antenna 20, which is attached to microwave energy source 14, is also preferably introduced into the combustor 16 via use of a waveguide retainer 22 and then through an installation tube 24. A spark plug is shown at 30, an intake valve generally at 28 and an exhaust valve generally at 30. But as noted above, the present invention would apply even in those situations where no spark plug is utilized, as in a diesel engine. In addition, as can be seen, the elongated waveguide antenna is preferably positioned as illustrated at 32 so that it is preferably not in the center of the combustor or cylinder 16, but the elongated length of the antenna is proximate a sidewall 34 of the cylinder, where the cylinder sidewall is understood to be an internal surface of the cylinder that defines at least in part the region for combustion. Also shown generally in FIG. 2 is the piston 36 which is then connected in the lower crankcase via the connecting rod 38 to a crankpin and to a crankshaft, which are not shown.

Preferably, the elongated waveguide antenna herein is positioned within the region 4.0 mm to 8.0 mm from an internal surface 34 of the cylinder that defines at least in part the region for combustion (i.e. the combustor or cylinder sidewall), more preferably in the region 5.0 mm to 7.0 mm, and even more preferably, in the region that is 5.0 mm to 6.0 mm from the cylinder sidewall. In addition, while the waveguide antenna is shown in FIG. 2 to be generally installed downwardly through a portion of the cylinder head structure, it can be appreciated that it may also be installed through the piston, cylinder sidewall, intake valve port or exhaust valve port. Accordingly, it should now be appreciated that for a given combustor or cylinder, one may utilize one or a plurality of waveguide antennas herein due to their size, such as 2-4 waveguide antennas in a given combustor configuration.

Other features of the waveguide antenna herein include a relatively long radiation distance to provide MEC. For example, it is contemplated that when employing the waveguide antenna herein in a preferred circular cross-sectional configuration, the emitted radiation is isotropic and can fill the entirety of the cylinder, and therefore enhance combustion not only at the relatively early stage of combustion, but also through-out the entire combustion cycle. For example, the radiation distance from the exposed tip of the waveguide antenna within the cylinder is in the range of 0 mm to the edge of the combustion chamber, e.g. 200 to 300 mm for a locomotive engine. However, it should be noted that the cross-sectional geometry of the waveguide antenna herein may include other rounded configurations, such as oval or elliptical. In addition, the waveguide antenna here may include a rectangular type cross-sectional configuration.

It may therefore now be appreciated that the waveguide antennas in the literature intends to focus RF energy to the tip to breakdown molecules for ignition, which requires relatively high energy, and is limited to a relatively short operation time for ignition only and a relatively short radiation range close to the tip. The antenna in this invention in preferred configuration is capable of transmitting microwave energy to cover the entire combustion chamber with duration to cover the entire combustion process. When electing to utilize a relatively low-cost and energy-efficient ignition system to start combustion, the antenna herein is capable of using relatively smaller energy to achieve a relatively better combustion enhancement by efficiently using microwave energy to accelerate the flames' already-breakdown electrons and radicals to directly boost their combustion chemical reactions.

Accordingly, the present invention provides an elongated waveguide antenna that provides MEC. In addition, given the above disclosed characteristics of the elongated waveguide antenna herein, it can now be appreciated that with respect to, e.g., gasoline engines, such a relatively small and the available area for installation of an antenna is relatively limited due to the required presence of intake and exhaust valves, injectors, spark plugs and internal fluid circuits. The elongated waveguide antenna herein is contemplated to be more readily capable of installation and retrofit into such existing engines, to provide significant improvements to the combustion cycle.

What is claimed is:

1. A combustion method comprising:

providing a combustor having a combustion region for introducing a combustible mixture, including an elongated waveguide antenna positioned in said combustor wherein said antenna is connected to a microwave power source and wherein said waveguide antenna indicates a thermal conductivity of at least 150 W/m–K;

introducing a combustible mixture into said combustor;

igniting said combustible mixture;

using microwave energy from said waveguide antenna to enhance combustion of said ignited mixture wherein igniting of said combustible mixture comprises spark initiation or sufficiently compressing said combustible mixture and igniting said mixture.

2. The method of claim 1 wherein said waveguide antenna comprises a metallic shell and a ceramic core wherein said ceramic core has a diameter of 8.0 mm to 12.0 mm and said metallic shell has a thickness of 1.0 mm to 2.0 mm.

3. The method of claim 1 wherein said elongated waveguide antenna has a length of 50 mm to 250 mm.

4. The method of claim 1 wherein said elongated waveguide antenna emits microwave radiation having a frequency of 7.0 GHz to 9.0 GHz.

5. The method of claim 2 wherein said ceramic core comprises aluminum nitride.

6. The method of claim 2 wherein said ceramic core comprises beryllium oxide.

7. The method of claim 1 wherein said microwave power source provides power in the range of 75.0 W to 500 W.

8. The method of claim 1 wherein said combustor includes an internal surface which defines at least in part a region for combustion and said elongated waveguide antenna is positioned 4.0 mm to 8.0 mm from said cylinder internal surface.

9. The method of claim 1 wherein said elongated waveguide antenna comprises a metallic shell and a ceramic core and indicates a thermal conductivity of 150 W/m–K to 300 W/m–k and said ceramic core comprises aluminum nitride.

10. The method of claim 1 wherein a plurality of elongated waveguide antennas are provided in said combustor.

11. The method of claim 1 wherein said combustor is positioned in a turbine engine.

12. The method of claim 1 wherein said combustor is positioned in a dual-fuel engine.

13. A combustion system for microwave enhanced combustion comprising:

a combustor having a combustion region for introducing a combustible mixture;

an elongated waveguide antenna positioned in said combustor wherein said antenna is connected to a microwave power source and wherein said waveguide antenna indicates a thermal conductivity of at least 150 W/m–K, wherein said antenna emits microwave energy that does not ignite said combustible mixture but is sufficient to enhance combustion once ignition is achieved wherein said elongated waveguide antenna has a length of 50 mm to 250 mm.

14. The system of claim 1 wherein said elongated waveguide antenna indicates a thermal conductivity of 150 W/m–K to 300 W/m–K.

15. The system of claim 1 wherein said elongated waveguide antenna comprises a metallic shell and a ceramic core wherein said ceramic core has a diameter of 8.0 mm to 12.0 mm and said metallic shell has a thickness of 1.0 mm to 2.0 mm.

16. The system of claim 1 wherein said elongated waveguide antenna comprises a metallic shell and a ceramic core and indicates a thermal conductivity of 150 W/m–K to 300 W/m–k and said ceramic core comprises aluminum nitride.

17. The system of claim 1 wherein said elongated waveguide antenna emits microwave radiation having a frequency of 7.0 GHz to 9.0 GHz.

* * * * *